US007680291B2

(12) United States Patent
Frieding

(10) Patent No.: US 7,680,291 B2
(45) Date of Patent: Mar. 16, 2010

(54) METHOD FOR OPERATING A HEARING DEVICE AND A HEARING DEVICE

(75) Inventor: Jan Frieding, Rapperswil (CH)

(73) Assignee: Phonak AG, Stafa (CH)

( * ) Notice: Subject to any disclaimer, the term of this patent is extended or adjusted under 35 U.S.C. 154(b) by 1183 days.

(21) Appl. No.: 11/210,175

(22) Filed: Aug. 23, 2005

(65) Prior Publication Data

US 2007/0053535 A1 Mar. 8, 2007

(51) Int. Cl.
*H04R 25/00* (2006.01)

(52) U.S. Cl. ..... 381/314; 381/312

(58) Field of Classification Search ..... 381/91, 381/92, 312, 314, 315, 317, 320, 321, 323; 704/200.1, 255, 256, 257, 271
See application file for complete search history.

(56) References Cited

U.S. PATENT DOCUMENTS 4,425,481 A * 1/1984 Mansgold et al. ..... 381/317
6,895,098 B2 5/2005 Allegro et al.
6,910,013 B2 * 6/2005 Allegro et al. ..... 704/256

FOREIGN PATENT DOCUMENTS

EP 0 064 042 A1 11/1982
EP 0 674 464 A1 9/1995
WO WO 01/22790 A3 4/2001

* cited by examiner

*Primary Examiner*—Huyen D Le
(74) *Attorney, Agent, or Firm*—Pearne & Gordon LLP

(57) ABSTRACT

For a method to operate a hearing device, a signal is recorded by at least one of several source units (S1, . . . , Sn). Furthermore, at least one of the recorded signals is classified into one or several predefined sound classes, characteristics of the source unit (S1, . . . , Sn), which records the signal, being taken into account during the classification. Finally, a hearing program is selected in the hearing device according to the classification result.

12 Claims, 1 Drawing Sheet

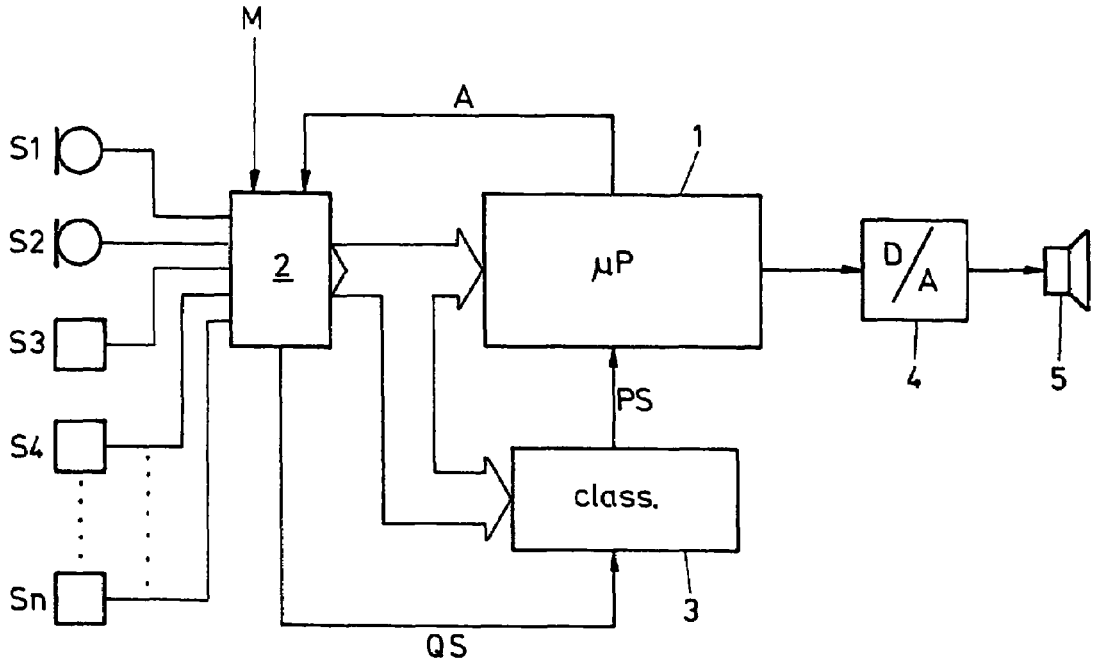
M
A
1
S1
S2
S3
S4
Sn
2
μP
D/A
4
5
PS
class.
3
QS

METHOD FOR OPERATING A HEARING DEVICE AND A HEARING DEVICE

TECHNICAL FIELD OF THE INVENTION

The present invention is related to a method to operate a hearing device as well as to a hearing device. It is noted that under the term "hearing device" so called hearing aids which are used to correct an impaired hearing ability of a person as well as all others communication devices, as e.g. radio sets, must be understood. Furthermore, all other applications, as e.g. implantable devices, fall under the term "hearing device".

BACKGROUND OF THE INVENTION

Modern hearing devices can be adapted to various acoustic and/or inductive surround situations with the aid of various hearing programs. Therewith, the hearing device is of use to the hearing device user in every situation. The adaptation, i.e. the switching between various hearing programs, is performed by manually activating a switch or a remote control as well as automatically with the aid of a suitable algorithm.

A method to automatically recognize a momentary acoustic or inductive surround situation, and to adjust a hearing program most suitable in the determined acoustic surround situation is known from the publication of the international patent application having a publication number WO 01/22790 A2, corresponding to U.S. Pat. No. 6,895,098. The known teaching is related to a very efficient algorithm with the aid of which the acoustic surround situation can be determined with a high reliability.

Furthermore, a method to automatically switch between hearing programs with the aid of a fuzzy-logic controller is known from EP-0 674 464 A1, the controller being realized in analog technique.

Finally, a programmable signal processing unit is disclosed by EP-0 064 042 A1, which signal processing unit allows a manual and automatic switching between hearing programs. However, useful criterions for the switching process have not been disclosed.

Therefore, an object of the present invention is to further improve a method to operate a hearing device.

SUMMARY OF THE INVENTION

A method to operate a hearing device is disclosed, the method comprises the steps of recording a signal by at least one of several source units, classifying at least one of the recorded signals in one or several predefined sound classes, characteristics of the source unit recording the signal being considered for the classification, and selecting a hearing program according to the result of the classification.

The present invention particularly has at least the following advantages: By recording a signal by at least one or several source units, by classifying at least one of the recorded signals into one or several given sound classes, the characteristics of the source unit which records the signal being considered for the classification, and by selecting a hearing program according to the classification, the classification can be performed faster and more accurately. As a result thereof, the hearing program most suitable for the momentary acoustic surround situation is selectable faster. Therefore, a method to operate a hearing program is provided that allows a faster adaptation of a hearing device to operating conditions actually present.

Further advantages become apparent to the skilled artisan from the following specific embodiments.

BRIEF DESCRIPTION OF THE DRAWING

The only FIGURE shows a block diagram of a hearing device according to the present invention in a schematic representation.

DETAILED DESCRIPTION OF THE INVENTION

The FIGURE schematically shows a block diagram of a hearing device. It is noted that under the term "hearing device" so called hearing aids which are used to correct an impaired hearing ability of a person as well as all other acoustic communication devices, as e.g. radio sets, must be understood. Furthermore, all other applications, as e.g. implantable devices, fall under the term "hearing device".

The hearing device depicted in the only FIGURE comprises, as it is known, several source units S1 to Sn, by which a signal being processed in the hearing device are received. The source units S1 to Sn can be one or several of the following units:

1. Microphone, including directional microphone, as electro-acoustic converter;
2. Telephone coil (T-Coil);
3. Audio input at the hearing device;
4. FM input (Frequency modulated input signal, i.e. a wireless FM receiver which is attached to the hearing device, for example).

Beside the source units S1 to Sn, the hearing device comprises a selection unit 2, a signal processing unit 1, a classification unit 3, a digital-to-analog converter 4 and a receiver 5, which can be implemented as miniature loudspeaker, for example.

The source units S1 to Sn are operationally connected to the signal processing unit 1 via the selection unit 2, the signals received by the source units S1 to Sn being converted into digital signals in the selection unit 2 in case the received signals are not already available in digital form. Although the block diagram shown in the FIGURE represents a digital hearing device, it is conceivable that the present invention is also applicable for a hearing device that is completely or partly realized using analog components. For such an analog embodiment of the present invention, the analog-to-digital and digital-to-analog converters are not mandatory.

The output signal of the selection unit 2 that is fed to the signal processing unit 1 is additionally fed to the classification unit 2, in which a momentary acoustic surround situation is being determined on the basis of characteristic features. Thereto, the characteristic features will be extracted during an extraction phase in the classification unit 2, the characteristic features being used as a basis for the classification of a momentary acoustic surround situation. Therefore, the result of this classification is the identification of the momentary acoustic surround situation or the information about the most probable momentary acoustic surround situation. According to the present invention, also information in connection with the selected source unit or source units are processed in the classification unit 3. Therewith, a hearing program can be selected that is most suitable to process the signals, recorded by the source units S1 to Sn, if necessary under consideration of the sound desired by the hearing device user. In the signal block diagram according to the only FIGURE, the selection of the hearing program is indicated by the operational connection between the classification unit 3 and the signal processing unit 1, which operational connection is marked PS.

Further information in relation to the classification or determination of the acoustic surround situation can, for example, be taken from the publication of the international patent application having publication member WO 01/22790 that corresponds to U.S. Pat. No. 6,895,098.

In the selection unit 2, one or several active source units S1 to Sn is/are selected beside a possible analog-to-digital conversion of the signals received by the source units S1 to Sn. The selection can either take place manually, for example by the hearing device user, or automatically, for example by the signal processing unit 1. The manual selection is indicated by the operational connection denoted by M in the FIGURE, over which operational connection, for example via a switch at the hearing device itself or via a remote control (both not depicted in the FIGURE), the hearing device or the selection unit 2 will be informed regarding which source unit or source units S1 to Sn are used as signal generator. Furthermore, it is, for example, possible to inform the hearing device over the same input possibility whether the selection of the active source unit or units must take place automatically or not. The automatic selection of the source unit S1 to Sn occurs by the signal processing unit 1 which is thereto connected to the selection unit 2 via the connection A.

One of the following methods can be applied for the automatic selection of the source unit or source units S1 to Sn:

A first method comprises the step of selecting a source unit S1 to Sn for which the signal noise ratio is the best.

A second method comprises the step of selecting a source unit S1 to SN for which the incoming signal most probably has the desired signal based on features in the time or/and frequency domain.

A further possible method comprises the step of selecting a source unit S1 to Sn which generates a signal in the time and/or the frequency domain that has the highest level comparatively.

For a further embodiment of the present invention, at least a hearing program is provided for each source unit S1 to Sn, the at least one hearing program being in particular suitable for the corresponding source unit S1 to Sn. As soon as a source unit S1 to Sn is selected by the selection unit 2, the corresponding hearing program is executed in the signal processing unit 1. Therewith, the circumstance is taken into account that certain source units S1 to Sn inherently imply a certain acoustic surround situation and affect in certain circumstances even the sound, for example in the dynamic and/or frequency response. This acoustic surround situation inherently contained in the source unit S1 to Sn is considered in the corresponding hearing program.

In the following, possible characteristics for the hearing programs are given for individual source units S1 to Sn according to the above-mentioned list:

Source: Telephone Coil (T-Coil)

The acoustic surround situation implied herein is the following: The signal is inductively fed to the hearing device; the room acoustics is insignificant. Typically, the desired signal is rather directly taken from a source (for example, a voice by a microphone) or is supplied, for example, by a tape recorder or a recorded announcement. The inductive desired signal can be superimposed by inductive interference fields. Such interference fields are, for example, humming sources from transformers, coils, power cables or fluorescent tubes.

Possible remedies for reduction of the interference fields consist, for example, by the use of an interference filter that attenuates the signal level in the frequency range of the humming sources. In the acoustic signal path of the hearing device, the room acoustics cannot be improved.

A telephone coil influences the sound in such a manner that sensibility is smaller for high and low frequencies. In the intermediate frequency range, the sound is though the same as for using a hearing device microphone. For the reduction of the sounds influence by the telephone coil, the high and low frequency ranges are therefore reproduced in an amplified manner.

Source: FM-Receiver

For a FM-(frequency modulated)-receiver, the desired signal is fed to the hearing device via a FM transmission, the acoustic surround situation in the vicinity of the hearing device is therefore insignificant. Typically, a desired signal transmitted via the FM transmission is directly recorded. For example, a voice is directly recorded at the speaker's position by a remote microphone, or a band recording or a recorded announcement is set via the FM transmission. It must be pointed out that LF (low frequency) bandwidth of the transmission is limited. Therefore, it is conceivable that the sound is optimized after the transmission because of the limited bandwidth of the transmission.

Because the acoustic surround situation in the vicinity of the hearing device has no influence on the desired signal transmitted via the transmission, no measures are to be taken in the acoustic path of the hearing device.

The transmission via FM transmission typically has a low dynamic, an also limited frequency response and a higher noise as result. By raising the weak frequency ranges, an adjustment of the dynamic of the hearing device amplifier to the expected dynamic or an application of a noise suppression unit (noise cancellers), the situation can improve.

Source: Direct Audio Input

The assumed acoustic surround situation is similar to the one of a telephone coil. Possibly, a signal already transmitted via a FM transmission is fed into the hearing device via the audio input. Accordingly, the above mentioned measures apply in order to improve the desired signal.

In addition, the same measures must be taken as already described in connection with the telephone coil.

The signal fed via the audio input typically is extremely broad-band (for example, a signal from a CD player) and has a high dynamic range. Accordingly, the broad-band signals must be processed by a suitable dynamic behavior of the hearing device amplifier.

Source: Several Sources, as for Example FM Transmission and Microphone, or Microphone and Telephone Coil Basically, many situations are possible which are all characterized in that two or more sources are available. These sources can generate signals which are simultaneous or which are staggered in time. Accordingly, the amplification in the hearing device must take into account the large dynamic range to be expected in order to sustain the intelligibility. For the automatic selection of the source unit or source units S1 to Sn, a further embodiment of the present invention consists in that for a switching from one source unit S1 to Sn to another, and therewith a hearing program change from a first to a second hearing program, is carried out in such a manner that an output signal generated according to a first hearing program is smoothly turned into an output signal generated by the second hearing program. Therewith, the hearing device user is not surprised or does not feel insecure by a hard switching from a first hearing program to a second. The hearing program switching is rather only perceived by the hearing device user in that the hearing capability is steadily improved through the selection of a better hearing program. In this connection, reference is made to the publication of the international patent application having publication number WO 02/05591 A2, which corresponds to US-2003-0091197-A1, of the same applicant.

On the other hand, a sudden switching from a presently used hearing program to a new hearing program is desired for a manual triggering by the hearing device user instead of a smooth transmission, because the hearing device user perceives the sudden change in acoustics as confirmation of the switching process. A slow steady or smooth transition for a manual triggering would otherwise only result in uncertainty because it can not be determined whether the switching process has been triggered at all.

The invention claimed is:

1. A method to operate a hearing device, the method comprising the steps of:

recording a signal by at least one of several source units, classifying at least one of the recorded signals in one or several predefined sound classes, characteristics of the source unit recording the signal being considered for the classification, the source unit recording the signal being selected from the several source units, and selecting a hearing program according to the result of the classification, wherein the hearing program is selected based on the selected source unit.

2. The method according to claim 1, wherein the source unit or source units that recorded a signal or signals are manually selected.

3. The method according to claim 1, wherein the source unit or source units that records or record the signal or signals, respectively, are automatically selected.

4. The method of claim 3, wherein the automatic selection of the source unit or source units is made based on a best signal to noise ratio of the several source units.

5. The method of claim 3, wherein the automatic selection of the source unit or source units is made based on signal features in the time and/or frequency domain.

6. The method according to claim 1, further comprising the steps of:

providing at least one specific hearing program for each selectable source unit, and selecting a hearing program in accordance with the selected source unit.

7. The Method according to claim 1, wherein a hearing program change from a first to a second hearing program is performed in such a manner that an output signal generated according to the first hearing program is smoothly turned into an output signal generated by the second hearing program.

8. A hearing device comprising at least two source units, a signal processing unit and a classification unit, the at least two source units being operationally connected to the signal processing unit, on the one hand, and to the classification unit on the other hand, and the classification unit being operationally connected to the signal processing unit, wherein a selection unit is provided that is operationally connected to the classification unit in order to transmit information regarding the selected source unit, wherein a hearing program of the signal processing unit is selected based on the information regarding the selected source unit.

9. The hearing device according to claim 8, wherein an input unit is operationally connected to the selection unit.

10. The hearing device according to claim 8, wherein the signal processing unit is operationally connected to the selection unit for the automatic selection of a source unit.

11. The hearing device according to claim 8, wherein the hearing program is a predefined hearing program that is selectable by selecting one of the source units.

12. The hearing device according to claim 8, wherein a hearing program change from a first to a second hearing program is selectable in such a manner that an output signal generated according to a first hearing program smoothly turns into an output signal generated by the second hearing program.

* * * * *